United States Patent [19]

Anquetin

[11] 4,107,767

[45] Aug. 15, 1978

[54] FLEXIBLE LIGHTING STRIP

[76] Inventor: Jacques Anquetin, 7, rue de la Gouttiere, 78640 Neauphle le Chateau, France

[21] Appl. No.: 792,373

[22] Filed: Apr. 29, 1977

[30] Foreign Application Priority Data

May 10, 1976 [FR] France ..... 76 13941

[51] Int. Cl.[2] ..... F21V 1/00

[52] U.S. Cl. ..... 362/236; 362/249; 362/252; 362/278; 362/285; 362/306; 362/307; 362/311; 362/320; 362/351

[58] Field of Search ..... 362/227, 236, 277, 278, 362/235, 249, 252, 306, 307, 285, 311, 320, 351; 313/1

[56] References Cited

U.S. PATENT DOCUMENTS

| | | | |
|---|---|---|---|
| 1,995,863 | 3/1935 | Prideaux | 313/312 X |
| 2,629,839 | 2/1953 | Greenlee | 313/201 |
| 2,644,113 | 6/1953 | Etzkorn | 313/1 X |
| 2,713,629 | 7/1955 | Etzkorn | 313/1 X |
| 3,042,022 | 7/1962 | Sheldon | 362/278 |
| 3,500,036 | 3/1970 | Szentveni | 362/249 X |
| 3,551,723 | 12/1970 | Groningen | 362/227 |
| 3,633,023 | 1/1972 | Castiglioni et al. | 362/249 |
| 3,714,414 | 1/1973 | Sternius | 362/249 |
| 3,894,225 | 7/1975 | Chao | 362/244 |

*Primary Examiner*—Richard E. Schafer

*Attorney, Agent, or Firm*—Beveridge, DeGrandi, Kline & Lunsford

[57] ABSTRACT

A flexible lighting strip comprises an elongate section of a plastics material having a portion formed as a cylindrical duct which houses a chain of electric lamps. At the rear of that portion is a hollow portion which contains a pair of conductors for feeding the lamps, and which is filled with a translucent polymerizable compound. Between those portions is a portion which has a longitudinal triangular slit, the apex of which opens into the duct so that connections from the conductors to the lamps pass transversely through the slit and are gripped at the apex. A thin metallic sheet covers the filling of translucent compound and is adhered thereto by polymerization of the compound. A double-sided adhesive tape is preferably attached to the metallic sheet for attachment of the lighting strip to a support such as a showcase.

10 Claims, 2 Drawing Figures

FLEXIBLE LIGHTING STRIP

This invention relates to a flexible electric lighting strip.

It is an object of the present invention to provide a flexible lighting strip which can be made in any length. It can, if necessary, be as long as 10 metres, or even longer, so that complete illumination of an area, for example a recess or a showcase in a dwelling or a shop, can be effected.

The strip in accordance with the invention comprises an elongate section of plastics material including a cylindrical cavity containing a chain of electric lamps; a rear portion containing longitudinal supply conductors for feeding the lamps from an electricity supply, the rear portion being filled with a translucent compound which adheres to the plastics material of the section; and a middle portion between the cavity and the rear portion and having a longitudinal triangular slit with its apex in communication with the cylindrical cavity; the strip further including a plurality of conductors interconnecting the supply conductors and the lamps and extending through and gripped at said apex; and a metallic sheet at the rear of the translucent compound and adhered to the compound.

Figure 1:
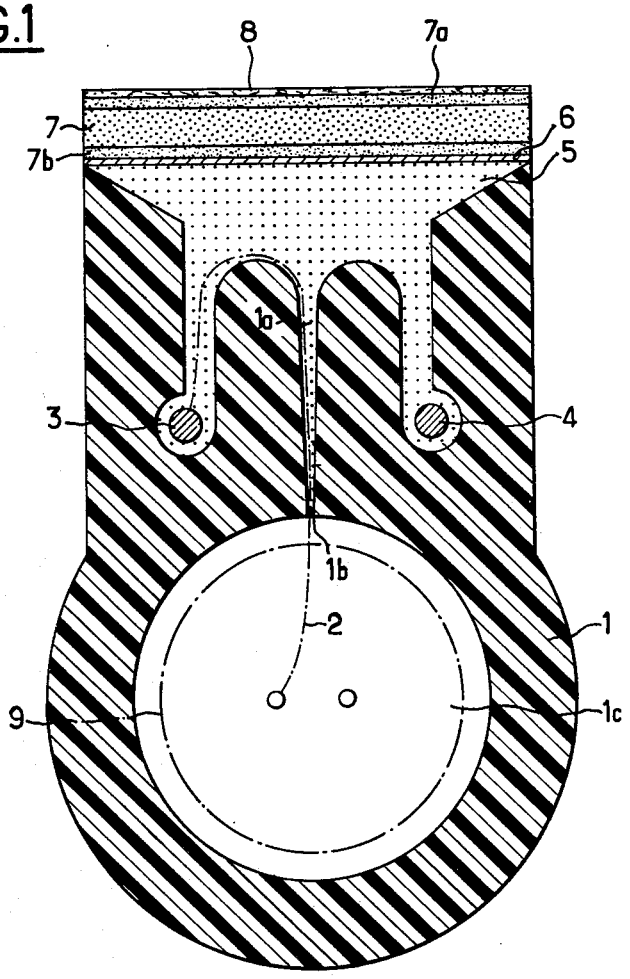
Figure 2:
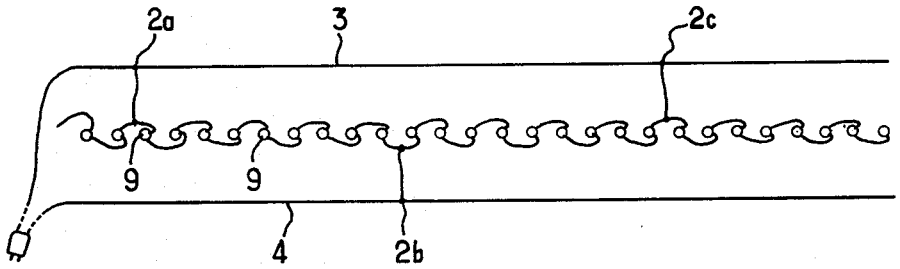

One embodiment of the invention will now be described, by way of example, with reference to the accompanying drawings, in which:

FIG. 1 is a transverse section through a flexible lighting strip in accordance with the invention, and FIG. 2 is a diagrammatic representation of the wiring of a chain of lamps in series-parallel.

Referring to FIG. 1, a section 1 of a plastics material capable of withstanding the heat produced by the lamps when operating comprises a portion having a longitudinal cylindrical cavity 1*c* and a portion extending therefrom which has a central slit 1*a* of triangular cross-section opening at its apex into the cylindrical cavity 1*c*. This portion also has longitudinal grooves carrying uninsulated conductors 3 and 4. The material is preferably a silicone rubber, such as that sold by the Rhone-Poulenc Company in Paris under the trade name "RHODORSIL RP 60". The portion containing the conductors 3 and 4 is filled with a translucent polymerisable compound 5, which insulates the conductors 3 and 4 and holds them in place. The translucent compound may be that sold by Barthelemy factory at Bobigny under the trade name "GEBSICONE".

A thin sheet 6 of polished aluminium or light alloy or other metal is adhered to the compound 5 by polymerisation of the compound, and acts as a reflector of the light emitted by the lamps 9 which are housed in the cavity 1*c*. The metallic sheet may be, for example, 10/100 m.m. thick.

A tape 7 of high-density polyurethane foam is provided with adhesive layers 7*a* and 7*b* on its opposite surfaces. The layer 7*b* adheres the tape to the sheet 6, so that the sheet 6 not only provides a reflecting surface but also provides a surface for adhesion of the tape 7, which would not adhere directly to the translucent compound. The layer 7*a* is covered with a paper backing layer 8 which can be pulled off so that the layer 7*a* can be used to fix the lighting strip in place in the area to be lit, such as on a piece of furniture, or round the periphery of a recess or a showcase.

FIG. 2 shows a suitable arrangement of the lamps 9 wherein they are connected in chains of nine lamps each between the supply conductors 3 and 4, so that a voltage of about 12 volts appears across each lamp when the conductors 3 and 4 are connected to a supply main having a voltage of 110/125 volts, or a voltage of about 24 volts appears across each lamp if the supply main voltage is about 220 volts. The points of connection between the chains of nine lamps are connected alternately to the conductor 3 and the conductor 4 by conductors 2*a* – 2*c* in such a way that the chains are supplied at the same voltage.

The conductors 2*a* – 2*c* etc. (exemplified by the conductor 2 in FIG. 1) pass through the slip 1*a* into the cavity 1*c* where they are connected to the lamp chains. The conductors are gripped at the edge 1*b* of the slit and are thereby held in place.

At the free end of the strip, the spacing of the lamps 9 in the last chain may be adjusted so that the strip can be cut to length in the immediate vicinity of one of the tapping conductors 2*a*, 2*b*, 2*c* etc, so that the strip is luminous over its whole length.

It is advantageous, in order to avoid abnormally high temperatures over certain sections of the strip when placed vertically, to provide, at least at the ends of the strip, plugs of the same polymerisable translucent compound, one of the plugs also acting to integrate the insulating sheaths of the supply cable, which sheaths are of the same plastics material as the strip, with the filling of compound and the plastics section. In certain cases it is also advisable, for the same reason, to provide, in particular in very long lighting strips, intermediate plugs of the same compound in positions such as between the individual chains of lamps.

I claim:

1. A flexible electric lighting strip, comprising an elongate section of plastics material including a longitudinal cylindrical cavity containing a chain of electric lamps; a rear portion containing longitudinal supply conductors for feeding the lamps from an electricity supply, the rear portion being filled with a translucent compound which adheres to the plastics material of the section; and a middle portion between the cavity and the rear portion and having a longitudinal triangular slit with its apex in communication with the cylindrical cavity; the strip further including a plurality of conductors interconnecting the supply conductors and the lamps and extending through and gripped at said apex; and a metallic sheet at the rear of the translucent compound and adhered to the compound.

2. A lighting strip as claimed in claim 1, including an adhesive tape attached to the metallic sheet for adhering the lighting strip to a support.

3. A lighting strip as claimed in claim 2, wherein the adhesive tape is formed of polyurethane foam.

4. A lighting strip as claimed in claim 1, wherein the section of plastics material is formed of a silicone rubber.

5. A lighting strip as claimed in claim 1, wherein the translucent compound is polymerisable, and adheres to the section and to the metallic sheet by virtue of polymerisation of the compound.

6. A lighting strip as claimed in claim 1, wherein the metallic sheet is formed of aluminium.

7. A lighting strip as claimed in claim 1, wherein the metallic sheet is formed of a light alloy.

8. A lighting strip as claimed in claim 1, wherein the metallic sheet acts as a reflector of light emitted by the lamps.

9. A lighting strip as claimed in claim 1, wherein the lamps are connected in at least one series chain, the or each chain being connected to the longitudinal supply conductors.

10. A lighting strip as claimed in claim 1, wherein the lamps are located in the cavity by the rigidity of the electrical conductors connecting the lamps.

* * * * *